US009295875B2

(12) United States Patent
Sarns et al.

(10) Patent No.: US 9,295,875 B2
(45) Date of Patent: Mar. 29, 2016

(54) RECUMBENT STEPPER

(75) Inventors: Richard N. Sarns, Ann Arbor, MI (US); Matthew P. Weber, Brighton, MI (US); Kirk Stanley Fiegel, Jackson, MI (US)

(73) Assignee: NUSTEP, INC., Ann Arbor, MI (US)

( * ) Notice: Subject to any disclaimer, the term of this patent is extended or adjusted under 35 U.S.C. 154(b) by 0 days.

(21) Appl. No.: 13/435,531

(22) Filed: Mar. 30, 2012

(65) Prior Publication Data

US 2013/0090217 A1 Apr. 11, 2013

Related U.S. Application Data

(60) Provisional application No. 61/469,308, filed on Mar. 30, 2011.

(51) Int. Cl.

| | |
|---|---|
| ***A63B 22/04*** | (2006.01) |
| ***A63B 23/04*** | (2006.01) |
| ***A63B 22/00*** | (2006.01) |
| *A63B 22/06* | (2006.01) |
| *A63B 71/06* | (2006.01) |
| *A63B 21/005* | (2006.01) |
| *A63B 21/00* | (2006.01) |
| *A63B 21/22* | (2006.01) |

(52) U.S. Cl.

CPC ..... *A63B 23/04* (2013.01); *A63B 22/0056* (2013.01); *A63B 21/0051* (2013.01); *A63B 21/157* (2013.01); *A63B 21/225* (2013.01); *A63B 71/0619* (2013.01); *A63B 2022/0038* (2013.01); *A63B 2022/0652* (2013.01); *A63B 2208/0238* (2013.01); *A63B 2225/09* (2013.01); *A63B 2225/687* (2013.01)

(58) Field of Classification Search

CPC .. A63B 23/04; A63B 22/0056; A63B 21/225; A63B 21/157; A63B 21/0051; A63B 71/0619; A63B 2225/09; A63B 2225/687; A63B 2022/0038; A63B 2208/0238; A63B 22/0046; A63B 22/06; A63B 22/0605; A63B 22/0611; A63B 2022/0611; A63B 2022/0617; A63B 2022/0635; A63B 2022/0652

USPC ..... 482/52, 62, 64, 57, 51

See application file for complete search history.

(56) References Cited

U.S. PATENT DOCUMENTS 1,872,256 A * 8/1932 Denney ..... A63B 22/0012 482/62

2,453,771 A * 11/1948 White ..... A61H 1/02 482/62

(Continued)

OTHER PUBLICATIONS

Polymer Plastics, http://polymerplastics.com/transparent_overview.shtml, archived: Mar. 3, 2001, retrieved: Oct. 24, 2013.*

*Primary Examiner* — Oren Ginsberg
*Assistant Examiner* — Megan Anderson
(74) *Attorney, Agent, or Firm* — Brinks Gilson & Lione

(57) ABSTRACT

A recumbent stepper system has a tubular frame, a left leg assembly, a right leg assembly and a resistance mechanism. The leg assemblies are supported by the frame for pivoting movement about a central pivot axis. The leg assemblies each include an upwardly extending pedal arm terminating in a pedal. A left belt is coupled to the pedal arm of the left leg assembly and engages a left one way clutch and a left pulley. A right belt is coupled to the pedal arm of the right leg assembly and engages a right one way clutch and a right pulley. The resistance mechanism directly engages the left and right one way clutches via a resistance mechanism belt.

7 Claims, 3 Drawing Sheets

(56) References Cited

U.S. PATENT DOCUMENTS

| | | | | | |
|---|---|---|---|---|---|
| 4,869,494 | A * | 9/1989 | Lambert, Sr. | A61H 1/02 | 482/60 |
| 4,949,993 | A * | 8/1990 | Stark et al. | 482/52 |
| 5,356,356 | A * | 10/1994 | Hildebrandt et al. | 482/62 |
| 5,836,855 | A * | 11/1998 | Eschenbach | 482/57 |
| 6,042,518 | A * | 3/2000 | Hildebrandt et al. | 482/57 |
| 6,361,479 | B1 * | 3/2002 | Hildebrandt et al. | 482/72 |
| 6,790,162 | B1 * | 9/2004 | Ellis et al. | 482/51 |
| 7,713,176 | B1 * | 5/2010 | Farney | 482/52 |
| 7,775,942 | B2 * | 8/2010 | Hildebrandt et al. | 482/62 |
| D650,871 | S * | 12/2011 | Sarns et al. | D21/670 |
| 8,562,491 | B2 * | 10/2013 | Merli | 482/52 |
| 2009/0124467 | A1 * | 5/2009 | Hildebrandt et al. | 482/62 |
| 2011/0237403 | A1 * | 9/2011 | Huber et al. | 482/57 |

* cited by examiner

RECUMBENT STEPPER

CROSS REFERENCE TO RELATED APPLICATION

This application claims priority to U.S. Provisional Patent Application 61/469,308, filed on Mar. 30, 2011, the entirety of which is hereby incorporated by reference.

BACKGROUND OF THE INVENTION

The present invention generally relates to equipment for physical therapy and/or general exercise. More particularly, this invention relates to a recumbent exercise machine which provides for the exercising and strengthening of the lower body in addition to cardiovascular conditioning. In so doing, the present invention includes lower body exercising coordinated with upper body exercising.

Those people who exercise for its many health benefits, and not specifically for rehabilitation purposes, typically desire equipment which is challenging, safe, fun, effective, convenient and which provides a benefit to a multiple number of muscle groups so that a total body workout is achieved in a relatively short period of time. When the equipment is for home use, especially by children, other important considerations include durability and cost.

Numerous types and varieties of physical therapy and exercise equipment are available for both clinical and home use. Of the many types, two of the most popular include the elliptical (hereinafter "ellipticals") and stationary bicycles. Each of these machines, however, has certain limitations concerning their ease of use, range of movement, safety, and the muscle groups worked.

Generally ellipticals include a pair of pedals which move up and down and back and forth, thereby crudely simulating walking or running, in response to the weight and physical effort of the patient or exerciser (hereinafter "user"). The pedals are connected to a mechanism which applies a resistance or load. This resistance is often adjustable so that the elliptical can accommodate users of various levels of physical conditioning and ability.

One limitation of ellipticals is that the user is typically required to stand during the exercise. Since the user is in an upright position, a significant amount of balance and coordination on the part of the user is required. In addition, ellipticals usually have a fixed stride length which is not ideal for all patients, and the elliptical motion generally has significant momentum which cannot be stopped immediately by a patient in an emergency.

One limitation of a stationary bicycle is that the seat is typically a narrow saddle seat positioned above a pair of rotatable pedals having a fixed range of motion. The rotation of the pedals is resisted by a brake or other resistance mechanism. The user is required to lean forward to hold onto a set of handles, which may be stationary or movable. In order to use a stationary bicycle, the user must be capable of climbing up onto the seat and must possess sufficient strength, balance, and coordination to maintain themselves on the narrow seat while pedaling over a fixed range of motion. Often, children cannot use a stationary bike because of the above requirements and further because they require constant supervision by the physical therapist to prevent possible injury to the patient upon collapse or loss of balance.

As can be seen from the above discussion, there is the need for an apparatus which allows the user to easily get on and off the apparatus with or without assistance. Furthermore, the apparatus should provide a high degree of stability and safety to the user so that the user can manipulate the machine without constant attention or supervision. Additionally, the apparatus should be adjustable to accommodate users of significantly different sizes and physical conditions while still being comfortable and ergonomically correct.

SUMMARY OF THE INVENTION

In overcoming the drawbacks and limitations of the known technology, a recumbent stepper system has a tubular frame, a left leg assembly, a right leg assembly and a resistance mechanism. The leg assemblies are supported by the frame for pivoting movement about a central pivot axis. The leg assemblies each include an upwardly extending pedal arm terminating in a pedal. A left belt is coupled to the pedal arm of the left leg assembly and engages a left one way clutch and a left pulley. A right belt is coupled to the pedal arm of the right leg assembly and engages a right one way clutch and a right pulley. The resistance mechanism directly engages the left and right one way clutches via a resistance mechanism belt.

The tubular frame may further include a first tubular structure and a second tubular structure, wherein the resistance mechanism is located substantially between the first and second tubular structures. The first and second tubular structures may each further include a curved forward member being forward of the leg assemblies—opposite a seat. The curved forward members each having curvatures substantially following a portion of a circular flywheel.

The first and second tubular structures may each further include an upper substantially straight member, each upper substantially straight member has a first end connected to the curved forward member and second end connected to a display stand.

The first and second tubular structures may each further include a lower substantially straight member; each lower substantially straight member has a first end connected to the curved forward member. The first and second tubular structures may each further include a curved rearward member, each curved rearward member has a first end connected to a second end of the substantially straight member and a seat assembly connected the second ends of the curved rearward members.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION

Figure 1:
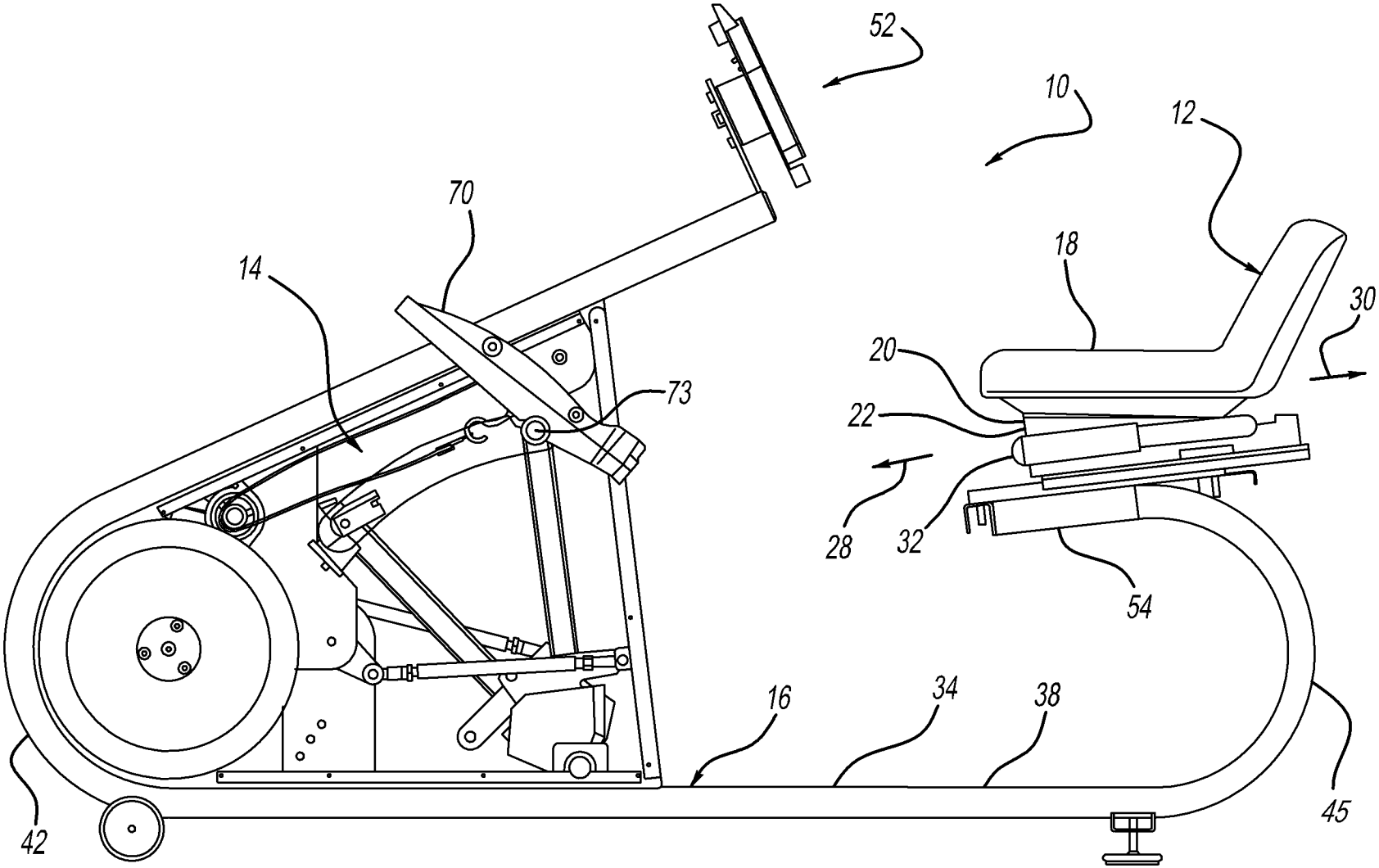
FIG. 1 illustrates a recumbent stepper.
Figure 2:
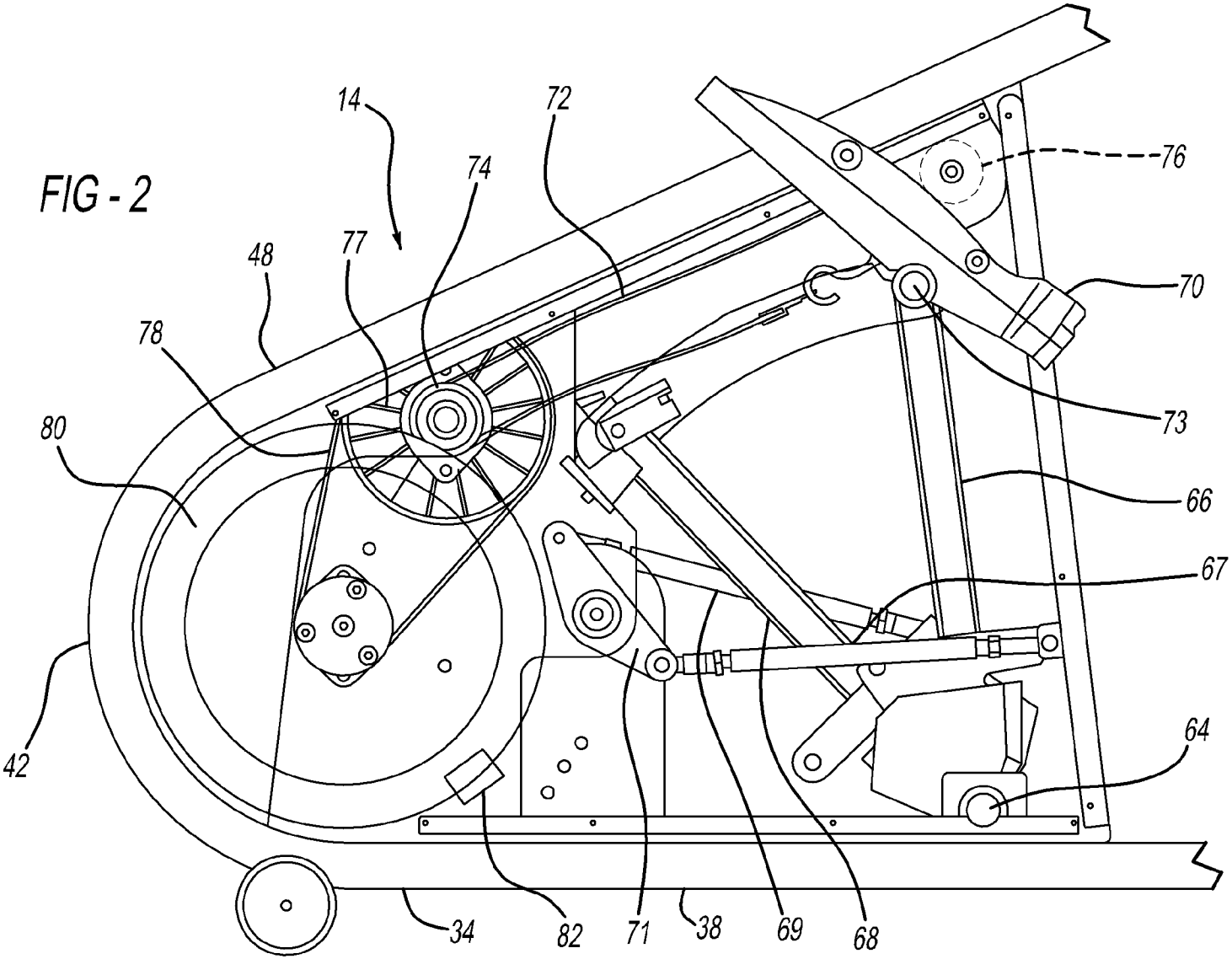
FIG. 2 illustrates a more detailed view of a resistance mechanism of the recumbent stepper.
Figure 3:
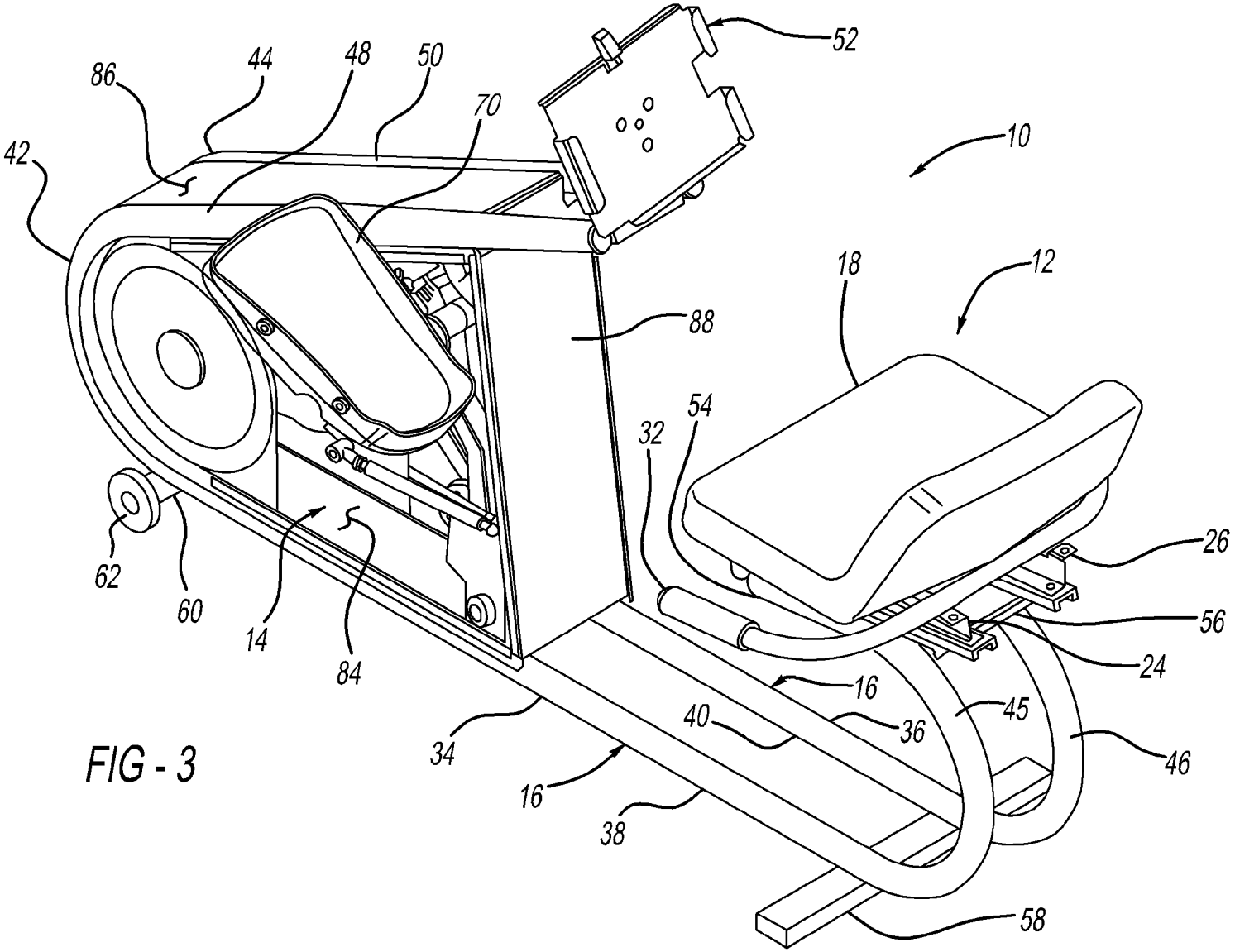
FIG. 3 illustrates a perspective view of the recumbent stepper of FIG. 1.

Referring to FIGS. 1, 2, and 3, a recumbent stepper system 10 is shown. As its primary components, the system 10 includes a seating area 12, a resistance mechanism 14 and a frame 16.

The seating area 12 includes a seat 18 so as to allow a user to sit on the seat 18. Coupled to the seat 18 may be a pair of slidable mounts 20 and 22. The slidable mounts 20 and 22 interact with a second set of slidable mounts 24 and 26 that are coupled to the frame 16. The slidable mounts 20 and 22 of the seat 18 interact with the slidable mounts 24 and 26 of the frame 16 so as to allow the seat 18 to be moved in either a forward direction as indicated by arrow 28 or a backwards direction as indicated by arrow 30. The sliding of the seat 18 is allowed or disallowed by a handle 32, which when engaged by the user allows the seat 18 to slide in either the forward direction 28 or the backward direction 30. Additionally, when the handle 32 is disengaged, the seat 18 will be in a fixed position and will not move.

As its primary components, the frame 16 includes a first tubular structure 34 and a second tubular structure 36. The first and second tubular structures 34 and 36 stand parallel to one another and are substantially similar in both size and shape. The first and second tubular structures 34 and 36 each include straight sections 38 and 40, respectively. The first and second tubular structures 34 and 36 each include curved portions 42 and 44 attached to one side of the straight sections 38 and 40. Additionally, located at the other end of the straight sections 38 and 40 are two additional curved portions 45 and 46, respectively. A second pair of straight sections 48 and 50 is attached to the curved portions 42 and 44, respectively.

The second straight sections 48 and 50 terminate with the display stand 52 capable of holding books, magazines, electronic devices, and other types of objects that a user of the system 10 would like to use when using the system 10 as well as electronic displays. Third straight sections 54 and 56 are attached to the curved portions 44 and 46. Although the frame 16 is described as having separate portions, the first tubular structure 34 of the frame 16 may be a unitary piece constructed from a single piece of tubing. In like manner, the second tubular structure 36 may also be a unitary piece constructed from a single piece of tubing.

In order to support the frame 16 in an upright position, the system 10 further includes a crossbar 58 coupled to the frame 16. Generally, the crossbar 58 has a length that is substantially perpendicular to the lengths of the first and second tubular structures 34 and 36. Additionally, a second crossbar 60 is located near the front of the system 10 below the resistance mechanism 14. The second crossbar 60 also has a length that is substantially perpendicular to the lengths of the first and second tubular structures 34 and 36. The second crossbar 60 may have wheels 62 attached to the ends of the second crossbar 60, allowing the system 10 to be moved using the wheels 62 when the system 10 is picked up from the backside of the system 10, near the seating area 12.

Referring to FIG. 2, the resistance mechanism 14 includes a central pivot 64 having a left pedal arm 66 and a right pedal arm 68 extending therefrom. The pedal arms 66 and 68 each have members 67 and 69 attached thereto. The opposite ends of members 67 and 69 are attached to a rocker arm 71. By so doing, the left pedal arm 66 and right pedal arm 68 are coupled together to move in a contra lateral manner, wherein when one of the pedal arms 66 or 68 moves, the other pedal arm assembly will move in an opposite direction.

Each of the pedal arms 66 and 68 have a pedal 70 attached thereto, wherein the user moves the left pedal arm 66 and right pedal arm 68 through the use of their feet by engaging the pedals 70. The pedals 70 move about an axis of rotation defined by the central pivot 64. The pedals 70 are free to rotate about their pivot 73 provided they are between travel stops.

When the user engages the pedals 70, the left pedal arm 66 engages a belt 72 which then engages a one way clutch 74 via a pulley 76. From the one way clutch 74, the belt 72 reattaches to the pedal arm 66. This essentially creates a loop where the belt 72 starts near the pedal 70 and then wraps around the one way clutch 74, continuing to the pulley 76, and then back to the pedal arm 66. While only one pedal 70, one belt 72, one clutch 74, and one pulley 76 are shown, it should be understood that the right pedal arm 68 has a similar arrangement, where it also has a pedal, a belt, a one way clutch, and a pulley, arranged similar to that described above concerning the left pedal arm 66.

The one way clutch 74 drives a wheel 77. The wheel 77 has a belt 78 which in turn drives a flywheel 80, which may be substantially circular. The rotation of the large flywheel 80 may be resisted through the use of an eddy current device 82, making the pedal 70 harder for the user to pedal or easier for the user to pedal. The resistance may be adjusted by moving the eddy current device 82, with its permanent magnets relative to the flywheel 80. Also, the curved portions 42 and 44 may have curve that generally follows a section of the flywheel 80.

The system 10 may further include side panels 84, a center panel 86 and a back panel 88. The side panels 84 are located on opposite sides of the system 10, proximate to the pedals 70. The center panel 86 is generally located at the front of the system 10, between the first tubular structure 34 and the second tubular structure 36. Finally, the back panel 88 is located between the first tubular structure 34 and the second tubular structure 36 but extends from straight sections 48 and 50 to straight sections 38 and 40. The side panels 84 and the center panel 86 may be transparent or semi-transparent. The back panel 88 may be opaque. However, it should be understood that the side panels 84, center panel 86 and back panel 88 may vary from being entirely transparent to semi-transparent to entirely opaque.

As a person skilled in the art will readily appreciate, the above description is meant as an illustration of an implementation of the principles of this invention. This description is not intended to limit the scope or application of this invention in that the invention is susceptible to modification, variation and change, without departing from the spirit of this invention, as defined in the following claims.

The invention claimed is:

1. A recumbent stepper system comprising:

a tubular frame;

a left leg assembly and a right leg assembly, left and right leg assemblies supported by the tubular frame for pivoting movement about a central pivot axis, left and right leg assemblies each including an upwardly extending pedal arm terminating in a pedal, wherein left and right leg assemblies are configured to only move in a contra lateral manner;

a track attached to the tubular frame;

a seat slideably attached to the track, whereby the seat can be repositioned by adjusting the seat along a length of the track, wherein the seat and track are located entirely rearward of the central pivot axis;

a left belt coupled to the pedal arm of the left leg assembly, the left belt engaging a left one way clutch and a left pulley;

a right belt coupled to the pedal arm of the right leg assembly, the right belt engaging a right one way clutch and a right pulley;

a resistance mechanism directly engaging the left and right one way clutches via a resistance mechanism belt, whereby the resistance mechanism resists the movement of the left and right assemblies;

wherein the resistance mechanism is located entirely forward of the central pivot;

wherein the tubular frame further comprises a first tubular structure and a second tubular structure, wherein the resistance mechanism is located substantially between the first and second tubular structures;

wherein the first and second tubular structures each further comprise a curved forward member being forward of left and right leg assemblies opposite the seat, the curved forward members each having curvatures substantially following a circular flywheel of the resistance mechanism;

wherein the first and second tubular structures each further comprise a curved rearward member being rearward of left and right leg assemblies opposite the resistance mechanism, the curved rearward members each having curvatures that terminate in matching substantially flat portions, the substantially flat portions of the rearward members defining a plane, the plane being substantially parallel to a surface supporting the recumbent stepper system;

the track connected to the substantially flat portions of the rearward members, the length of the track is parallel to the surface supporting the recumbent stepper system.

2. The system of claim 1, wherein the first and second tubular structures each further comprise a substantially straight member, each substantially straight member has a first end connected to the curved forward member and second end connected to a display stand.

3. The system of claim 2 further comprising a housing enclosing the resistance mechanism.

4. The system of claim 3, wherein the housing is at least partially transparent.

5. The system of claim 1, further comprising a housing enclosing the resistance mechanism.

6. The system of claim 5, wherein the housing is at least partially transparent.

7. The system of claim 1, wherein the right belt is directly coupled to the pedal arm of the right leg assembly and the left belt is directly coupled to the pedal arm of the left leg assembly.

* * * * *